US012590428B2

(12) United States Patent
Johansson

(10) Patent No.: US 12,590,428 B2
(45) Date of Patent: Mar. 31, 2026

(54) SAFETY BARRIER

(71) Applicant: Worxsafe AB, Östersund (SE)

(72) Inventor: Pär Johansson, Östersund (SE)

(73) Assignee: Worxsafe AB, Östersund (SE)

( * ) Notice: Subject to any disclaimer, the term of this patent is extended or adjusted under 35 U.S.C. 154(b) by 571 days.

(21) Appl. No.: 17/919,656

(22) PCT Filed: May 7, 2020

(86) PCT No.: PCT/EP2020/062776
§ 371 (c)(1),
(2) Date: Oct. 18, 2022

(87) PCT Pub. No.: WO2021/223869
PCT Pub. Date: Nov. 11, 2021

(65) Prior Publication Data

US 2025/0163660 A1 May 22, 2025

(51) Int. Cl.
*E01F 15/08* (2006.01)

(52) U.S. Cl.
CPC ..... *E01F 15/088* (2013.01)

(58) Field of Classification Search
CPC ..... E01F 15/088
See application file for complete search history.

(56) References Cited

U.S. PATENT DOCUMENTS 4,665,673 A * 5/1987 Diana ..... B28B 1/008 52/316
5,046,884 A * 9/1991 Girotti ..... E01F 15/088 404/6
5,123,773 A * 6/1992 Yodock ..... E01F 15/088 404/6
5,149,224 A 9/1992 Smith
(Continued)

FOREIGN PATENT DOCUMENTS

CA 2234374 A1 10/1999
CH 443387 A 9/1967
(Continued)

OTHER PUBLICATIONS

Japanese Office Action issued on Feb. 27, 2024 for Japanese Patent Application No. 2022-567093.
(Continued)

*Primary Examiner* — Matthew R Mcmahon
(74) *Attorney, Agent, or Firm* — Volpe Koenig

(57) ABSTRACT

A safety barrier is provided. The barrier has a length, a width, and a height. The barrier has an end connection at an end of the safety barrier, which end connection is arranged to be connected with a corresponding end connection of another safety barrier. The end connection comprises a receiving space adapted to receive at least a portion of an end connection of another safety barrier, and to only enable connection and disconnection with the corresponding end connection of another safety barrier by movement of the
(Continued)

safety barriers relative to each other in direction of the height of the safety barrier. A distance through the receiving space between wall surfaces of the receiving space in the direction of the length of the safety barrier is at a minimum between upper and lower ends of the end connection and is greater at the ends.

14 Claims, 8 Drawing Sheets

(56) References Cited

U.S. PATENT DOCUMENTS

| | | | | | |
|---|---|---|---|---|---|
| 5,464,306 | A * | 11/1995 | Cristiano | E01F 15/083 404/6 |
| 9,422,681 | B2 * | 8/2016 | Smith | E01F 15/083 |
| 9,631,784 | B2 * | 4/2017 | Torres, Jr. | B29C 39/10 |
| 10,184,219 | B2 * | 1/2019 | McMaster | E01F 15/085 |
| 2004/0146346 | A1 * | 7/2004 | Perelli | E01F 9/70 404/6 |
| 2009/0297263 | A1 * | 12/2009 | Redlberger | E01F 15/088 404/6 |
| 2012/0269574 | A1 * | 10/2012 | Redlberger | E01F 15/083 404/6 |
| 2015/0218763 | A1 | 8/2015 | Smith | |
| 2016/0010294 | A1 | 1/2016 | Mcmaster | |
| 2020/0308786 | A1 * | 10/2020 | Hood | E01F 13/02 |
| 2024/0110348 | A1 * | 4/2024 | Seguin | E01F 15/006 |

FOREIGN PATENT DOCUMENTS

| | | | | |
|---|---|---|---|---|
| CN | 102713073 | A | 10/2012 | |
| CN | 104963305 | A | 10/2015 | |
| DE | 10316911 | A1 | 10/2004 | |
| DE | 102007006746 | A1 * | 8/2008 | E01F 15/083 |
| DE | 202013003603 | U1 * | 8/2013 | E01F 15/083 |
| EP | 1467028 | A1 | 10/2004 | |
| EP | 3441528 | A1 * | 2/2019 | E01F 15/088 |
| FR | 2786211 | A1 | 5/2000 | |
| JP | 3008419 | U | 3/1995 | |
| JP | 2010070903 | A | 4/2010 | |
| JP | 2012509423 | A | 4/2012 | |
| JP | 2020084484 | A | 6/2020 | |
| WO | WO-2010057233 | A1 * | 5/2010 | E01F 15/083 |
| WO | 2011/088485 | A1 | 7/2011 | |
| WO | 2021/223869 | A1 | 11/2021 | |

OTHER PUBLICATIONS

Chinese Office Action issued on Nov. 5, 2024 for Chinese Patent Application No. 202080100319.5.

International Preliminary Report on Patentability mailed on May 20, 2022 for PCT International Application No. PCT/EP2020/062776.

International Search Report mailed on Jan. 13, 2021 for PCT International Application No. PCT/EP2020/062776.

* cited by examiner

SAFETY BARRIER

TECHNICAL FIELD

The present invention is related to a safety barrier.

BACKGROUND

In the fields of, and fields similar to and/or related to, construction and roadwork, it is important to separate workers from passers-by, such as vehicles, bicyclists and pedestrians, and/or to separate vehicles from each other. In the case of roadwork, there may also be of interest to reroute traffic. Hence, the solution has been to separate construction/work sites and/or to reroute traffic with the help of safety barriers (also known as Jersey barriers). It is of interest that the safety barriers are sturdy and substantially immovable once they have been installed. Further, the use of safety barriers may only be required temporarily, due to the construction/work only taking a limited amount of time. Therefore, the need for sturdy (i.e. heavy and/or robust) and temporary safety barriers have resulted in safety barriers which may be engaged/linked together to form a chain of safety barriers. It is well known within the art to engage safety barriers by lifting a safety barrier above a corresponding safety barrier, and then lowering it down such that a connection portion of one of the safety barriers may be inserted into the other. In other words, safety barriers are engaged in the same way as two pieces of a jigsaw puzzle are engaged. The connection portion of such a safety barrier is hook-shaped, as in the barrier shown in WO2014/036237 A1. However, the need to quickly install the safety barriers, combined with the safety barriers being heavy, causes a substantial health risk for the workers installing the safety barriers.

SUMMARY

In view of the above discussion, a concern of the present invention is to provide a safety barrier which is easier and safer to interconnect. To address at least one of these concerns and other concerns, a safety barrier in accordance with the independent claim is provided. Preferred embodiments are defined by the dependent claims.

The safety barrier has a length, a width, and a height. The barrier has an end connection at an end of the barrier. The end connection is arranged to be connected with a corresponding end connection of another barrier. The end connection comprises a receiving space adapted to receive at least a portion of an end connection of another barrier, and to only enable connection and disconnection with said corresponding end connection of another barrier by movement of the barriers relative to each other in direction of the height of the barrier. A distance through the receiving space between wall surfaces of the receiving space in the direction of the length of the barrier is at a minimum between upper and lower ends of the end connection and is greater at the ends. It is to be understood, in the context of the present application, that by the term "temporary" it is meant, for example, non-permanent, momentary, provisional, and/or time-limited. It should be noted that the safety barrier is advantageous in temporary use, due to its mounting/demounting qualities, but it is also useful for long term or permanent use. The height of the safety barrier may be understood as a vertical extension of the safety barrier. The length of the safety barrier may be understood as a longitudinal extension of the safety barrier. The length and the width may be perpendicular to each other. Further, the length and the width may each be understood as horizontal extensions of the safety barrier. The distance through the space between wall surfaces of the receiving space being at a minimum between upper and lower ends of the connection may allow for a secured connection between barriers. The distance through the space between wall surfaces of the receiving space being greater at the ends may allow for easier, and thereby faster and safer, connection of barriers due to there being more space at the ends of end connection. Additionally, it may allow for two engaged barriers to be arranged at an angle to each other while there is a connection between the barriers to remain secured between upper and lower ends of the end connection. By the term "at an angle to each other", it is for example meant that the barriers are arranged relative to each other, such that the longitudinal axes, the lateral axes, and/or the transversal axes of the barriers are arranged at an angle relative to each other. By the term "secured", it is for example meant engaged, locked, interlocked, tight, connected, established, and/or stable. The abovementioned features may increase the versatility of the barrier, due to it being able to be installed in uneven terrain, while still having a tight fit. In order to engage two barriers, one may raise a barrier such that the end connection of the barrier is above the end connection of the corresponding end connection of the other barrier, and then engage the end connections of the barriers by lowering the raised barrier. With a distance, which is greater at the ends, it is easier to engage the end connections of the barrier, thereby increasing the safety of the barrier. The end connection may be understood as comprising a hook-shape, or a J-hook-shape, which may be configured to engage with a corresponding end connection of another barrier.

According to an exemplary embodiment, a distance through the receiving space between wall surfaces of the receiving space in the direction of the width of the barrier is at a minimum between the upper and lower ends of the end connection and is greater at the ends. Therefore, the barrier may allow for a more secured connection between barriers, and an even easier connection of barriers due to the distance, in the direction of the width of the barrier, being at a minimum between upper and lower ends of the end connection and being greater at the ends.

According to an exemplary embodiment, the end connection is elongated in direction of the height of the barrier, and the distance is at a minimum at the longitudinal middle of the end connection. Thereby, the versatility of the barrier may be increased, due to it being able to be installed in more uneven terrain.

According to an exemplary embodiment, the distance is at a maximum at the longitudinal ends of the end connection. Hence, the distance through the space between wall surfaces of the receiving space is greatest at the ends which allows for an easier connection of barriers.

According to an exemplary embodiment, the end connection has a longitudinal extension along the height of the barrier, a lateral extension along the width of the barrier, and a transverse extension along the length of the barrier. The end connection has a transverse protrusion which is at a maximum between longitudinal ends of the end connection and is lesser at the ends. The transverse extension may allow for a secured connection between barriers at between the upper and lower ends of the end connection, while having some leeway at the ends. The transverse extension may allow for barriers to be engaged at a tilt relative to each other, with regards to axes along the lengths of the barriers. For example, one may need to install safety barriers along a stretch of terrain, which comprises a flat section and an inclined section, and the present inventive concept may be installed where there is such a sudden increase in incline. Hence, a continuous connection of barriers may be done, which increases the sturdiness of the engaged safety barriers, and thereby the degree of safety provided by the safety barriers.

According to an exemplary embodiment, the transverse protrusion is at a maximum at the longitudinal middle of the end connection. Thereby, a barrier may tilt equally in both directions, relative a corresponding engaged barrier. The ability to tilt equally, may allow for a more versatile barrier.

According to an exemplary embodiment, the transverse protrusion is at a minimum at the longitudinal ends of the end connection. Therefore, it may be easier to connect two barriers, thereby increasing the safety and efficiency of the barrier.

According to an exemplary embodiment, the end connection further comprises a base portion and a connection portion. The connection portion is protruding from the base portion in direction of the length and width of the barrier. Each of the base portion and the connection portion is elongated and has a longitudinal extension along the height of the barrier, a lateral extension along the width of the barrier, and a transverse extension along the length of the barrier. The base portion and the connection portion may be understood as comprising a hook-shape, or a J-hook-shape. The base portion and connection portion may increase the strength of connection between barriers. Further, the base portion and connection portion may secure the barriers from separating in all directions except along the height of the barriers.

According to an exemplary embodiment, the base portion comprises a longitudinal groove, wherein a wall surface of the groove and a wall surface of the connection portion define the receiving space. The receiving space is adapted to receive the connection portion of another barrier, wherein the connection portion is arranged to engage with the corresponding connection portion of the other barrier.

According to an exemplary embodiment, the distance through the receiving space between the wall surfaces of the groove and the connection portion is at a minimum between longitudinal ends of the connection portion and is greater at the longitudinal ends. Thereby, the connection may be secured while allowing for easier connection of barriers. Additionally, the differing distance allows for different orientation of connected barriers, while maintaining a secured connection.

According to an exemplary embodiment, a transverse extension of the connection portion is at a maximum between longitudinal ends of the connection portion and is lesser at the longitudinal ends. This may allow for two connected barriers to rotate and/or tilt with regards to each other.

According to an exemplary embodiment, the lateral extension of the connection portion is at a maximum between upper and lower longitudinal ends of the connection portion and is lesser and the longitudinal ends. Thereby, the lateral extension may decrease from between upper and lower longitudinal ends to the longitudinal ends. The decrease may be viewed as for example a funnel and/or guiding section, which may make it easier to connect two safety barriers. The decrease may allow for reducing the required height which one needs to lift one barrier in order to connect it to another barrier, which may increase the efficiency and safety of the barrier. Further, the lateral extension of the connection portion may be at a maximum at the longitudinal middle of the end connection. Furthermore, the lateral extension of the connection portion may be at a minimum at the longitudinal ends of the end connection.

According to an exemplary embodiment, the end connection comprises a shape such that, when received by a receiving space of another barrier, it allows for rotation and/or tilt of the barrier, with regards to the other barrier. By the term "received by a receiving space of another barrier", it is for example further meant that the end connection is engaged with a corresponding end connection of another barrier.

The end connection may be integral with the body of the barrier. The body of the barrier and the end connection may be comprised by the same material. The body of the barrier and the end connection may be formed together. For example, the body of the barrier may be comprised by a frame and a barrier material, wherein the barrier material may comprise the end connection. An end connection which is integral with the body of the barrier may be more durable. The barrier may be formed by a shell of a material, and then then filled with another material. For example, the barrier may be comprised by an outer metal shell, and then filled with concrete. The barrier may be monolithic. In other words, the barrier may be formed by a single piece of material. The barrier may be formed by a single piece of concrete, for example. The present inventive concept is not limited by the material concrete, and may be formed by any material, such as any metal material, or plastic material. A monolithic barrier may be easier to produce, and therefore cheaper to produce. Further, the barrier may have a supporting frame arranged inside the barrier.

BRIEF DESCRIPTION OF THE DRAWINGS

Exemplifying embodiments of the invention will be described below with reference to the accompanying drawings.

Figure 1:
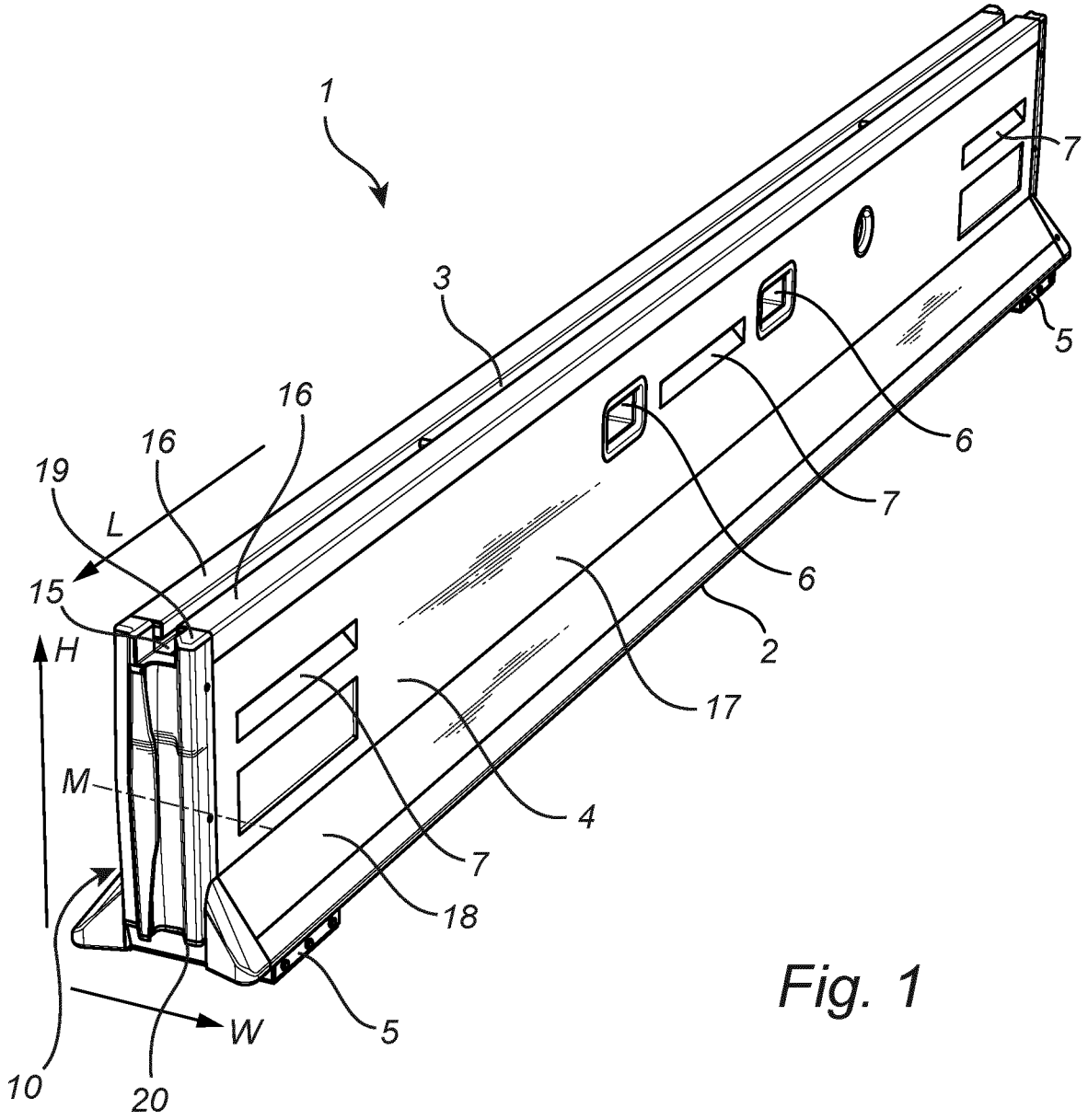
FIG. 1 is a schematic and perspective view of a safety barrier according to one or more exemplifying embodiments of the present invention.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments of the present invention are provided by way of example so that this disclosure will convey the scope of the invention to those skilled in the art. In the drawings, identical reference numerals denote the same or similar components having a same or similar function, unless specifically stated otherwise.

FIG. 1 is a schematic and perspective view of a safety barrier according to an exemplifying embodiment of the present invention. The barrier 1 has a length L, a width W, and a height H. The length L of the barrier 1 is greater than the height H of the barrier 1. The height H of the barrier 1 is greater than the width W of the barrier 1, though it should be noted that in other embodiments the width may be greater than the height. The barrier 1 has a bottom 2 and a top 3, where the bottom has greater width than the top. The greater bottom width increases the stability of the barrier 1. Further, the barrier 1 has a body 4. The body 4 of the barrier 1 has substantially the same cross-section along the whole length L of the body 4. The body 4 comprises a mid body portion 17 and two side body portions 18 at either side of the mid body portion 17. The shape of the cross-section of the body 4 is substantially comprised by three shapes, where the cross-section of the mid body portion 17 is a rectangle and the cross-section of the side body portions 18 is a triangle. The two triangles are arranged such that a short side of the rectangle and one side, i.e. a leg, of each triangle form the base of the barrier 1. Another side of the triangle, thus, extends along a long side of the rectangle, and it reaches a height corresponding to at least a part of the total height of the barrier 1, typically less than half the height. The barrier 1 in FIG. 1 further comprises four feet 5, arranged, substantially, at the corners of the underside of the barrier 1. The shown barrier 1 further comprises two holes 6, through the barrier 1 in a direction along the width W of the barrier 1. The holes 6 may be adapted for use when lifting and/or moving the barrier 1, such as with the help of a forklift or another kind of work vehicle. Additionally, the barrier 1 comprises three indents 7 arranged on a side of the barrier 1. The barrier 1 further comprises corresponding indents 7 on the opposite side. The indents 7 may be adapted for gripping the barrier 1. The barrier 1 comprises an elongated recess 15 at the top 3 thereof. The recess 15 extends along the length L of barrier 1 between two opposite edge sections 16. The recess 15 and the edge sections 16 may be used for attaching accessories like sound dampening walls, sign holders, etc. It should be noted that the numbers of indents, etc. given above may be different depending on how long the barrier 1 is.

The barrier 1 further comprises an end connection 10 arranged at an end of the barrier 1. The end connection 10 is arranged to engage with a corresponding end connection 10 of another safety barrier, see FIG. 5. To obtain that engagement, the end connection 10 comprises a receiving space 11 adapted to receive at least a portion of an end connection of another barrier, and to only enable connection and disconnection with said corresponding end connection of another barrier by movement of the barriers 1 relative to each other in direction of the height H of the barrier 1. A distance through the receiving space 11 between wall surfaces of the receiving space 11 in the direction of the length L of the barrier 1 is at a minimum between upper and lower ends 19, 20 of the end connection 10 and is greater at the ends 19, 20.

The end connection 10 comprises a base portion 12 and a connection portion 13, which protrudes transversally from the base portion 12. The base and connection portions 12, 13 are further described in conjunction with FIG. 2. The shown end connection 10 is a separate part that has been attached to the body 4 of the safety barrier 1, and more particularly to an end of the body 4. However, it is to be understood that the end connection 10 may be integral with the body 4 of the barrier 1. In this embodiment the barrier 1 comprises one end connection 10 at each end thereof. The end connections 10 are mirrored, and thereby it does not matter which way you turn two barriers 1 to be interconnected. The end connections 10 will fit together anyhow.

Figure 2:
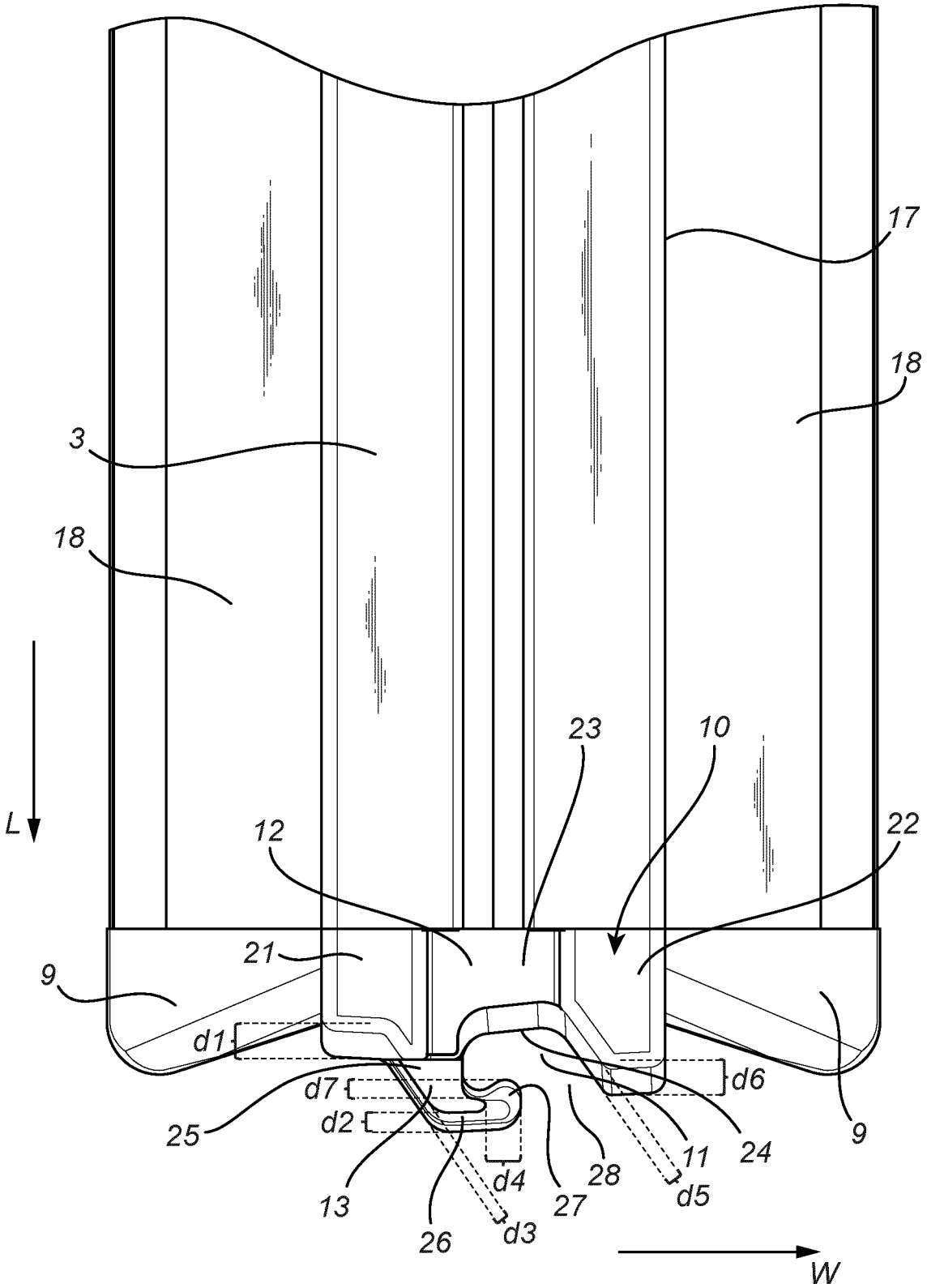
FIG. 2 is a schematic and perspective view of a safety barrier according to one or more exemplifying embodiments of the present invention.

FIG. 2 is a schematic and orthogonal view of a safety barrier 1 according to one or more exemplifying embodiments of the present invention. FIG. 2 shows a barrier las seen from above. More particularly, FIG. 2 shows a portion of the safety barrier 1, wherein the portion comprises an end of the barrier 1. An end connection 10 is arranged at the end of barrier 1. The end connection 10 has the same width as the top 3 and the mid body portion 17 of the body 4. The barrier 1 comprises end caps 9, which are arranged on the longitudinal ends of the side body portions 18. Each end cap 9 has a transverse extension, along the length of the barrier 1, which varies in the lateral direction, i.e. along the width W of the barrier 1, and which has a minimum at the transition between the triangle and the rectangle. The end connection 10 is elongated in direction of the height of the barrier 1, and has a transverse extension along the length L of the barrier 1, which is at a maximum between the upper and lower ends 19, 20, i.e. longitudinal ends, of the end connection 10 and is lesser at the ends 19, 20. Preferably, the transverse extension is at a maximum at the longitudinal middle M of the end connection 10. Preferably, the transverse extension of the end connection 10 is at a minimum at its longitudinal ends 19, 20. The transverse extension of the end connection 10 is defined as the distance from a planar two-dimensional, i.e. along the height and width of the barrier 1, interface between the end connection 10 and the body 4, and the free end of the end connection 10. Thus, with this definition the transverse extension is equivalent to a transverse protrusion of the end connection 10.

The base portion 12 has a first side portion 21, at a first side of the barrier 1, a second side portion 22, at a second side of the barrier 1, laterally opposite of the first side portion 21, and a middle portion 23 laterally between the first and second side portions 21, 22. The base portion 12 comprises a longitudinal groove 24. The connection portion 13 has a first transverse portion 25 protruding transversally away from the base portion 12, at the first side portion 21, a lateral portion 26 protruding laterally from the first transverse portion 25 away from the first side portion 21 of the base portion 12, and a second transverse portion 27 protruding transversally from the lateral portion 26 towards the middle portion 23 of the base portion 12. Thus, the first and second transverse portions 25, 27 protrude in opposite transverse directions.

A wall surface of the groove 24 and a wall surface of the connection portion 13 define the receiving space 11, such that the receiving space 11 is adapted to receive the connection portion 13 of another barrier 1. This can alternatively be regarded as surface portions of the longitudinal groove 24 and the connection portion 13 facing each other define the receiving space 11. More particularly, a cross-section of the receiving space 11 and a cross-section of the connection portion 13 are similar in shape, though the cross-sectional area of the space 11 is slightly larger than that of the connection portion 13. The connection portion 13 is arranged to engage with the corresponding connection portion of the other barrier, see FIG. 5. Due to the shape of the connection portion 13, for instance resembling a hook-shape, it is only possible to receive a connection portion 13 in the receiving space 11 by entering it from above or below of the end connection 10, i.e. in direction of the height of the barrier 1. Thus, the engagement of the two end connections 10 prevent disconnection by pulling the barriers 1 apart or pulling them in opposite directions to the sides. The receiving space 11 has a longitudinal opening 28 extending along the whole length of the connection portion 13.

Both the first side portion 21 and the second side portion 22 has a transversal extension that varies along the length of the base portion 12. More particularly, they protrude transversally to a different extent at different positions along the base portion 12. The difference in protrusion is indicated with d1 and d6, respectively in FIG. 2. Thus, the first and second side portions 21, 22 have, for instance, curved end surfaces at their lateral ends, or edges. Correspondingly, the wall surface of the groove 24, which is formed in the middle portion 23 of the base portion 12, is non-planar and protrude to a different extent along the length of the base portion 12, giving the middle portion 23 a varying extent, as indicated with the extension difference d5. It is to be understood that the different sections of the wall surface of the groove 24 face different directions, and thereby the extension difference d5 of the middle portion 23 is partly lateral and partly transverse.

Figure 6:
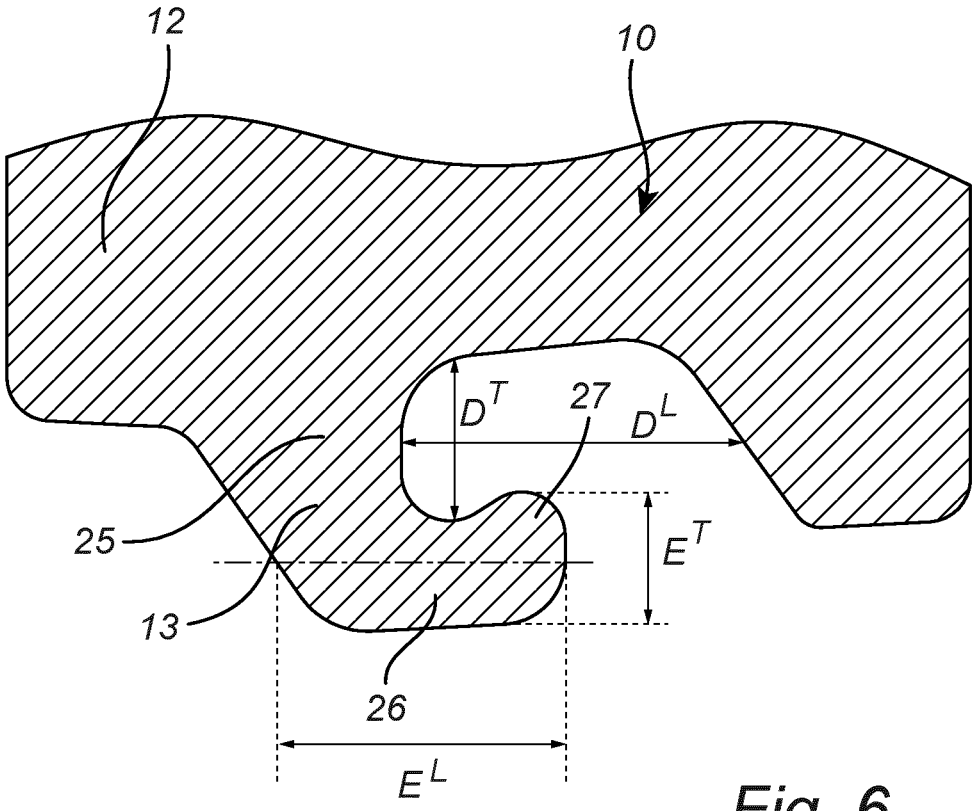
FIG. 6 is a schematic and cross-sectional view of an end connection of a safety barrier according to one or more exemplifying embodiments of the present invention.
Figure 7:
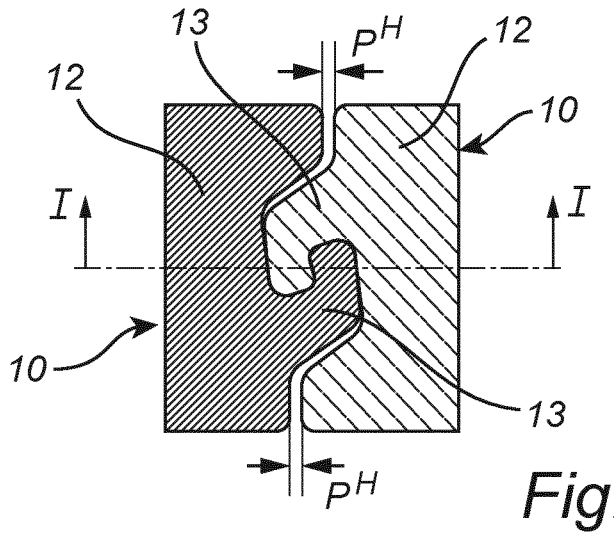
FIGS. 7-9 are schematic and sectional views of end connections of two engaged safety barriers according to one or more exemplifying embodiments of the present invention.

Just like the end connection 10 as a whole, each of the base portion 12 and the connection portion 13 has a longitudinal extension along the height H of the barrier, a lateral extension along the width W of the barrier, and a transverse extension along the length L of the barrier. The transverse extension of the connection portion 13 differs along its length, such that the transverse extension of the connection portion 13 is at a maximum between the longitudinal ends 29, 30 of the connection portion 13 and is lesser at the longitudinal ends 29, 30 thereof. Preferably, the transverse extension of the connection portion 13 is at a maximum at the longitudinal middle M of end connection 10. Preferably, the transverse extension of the connection portion 13 is at a minimum at the ends 29, 30 of the connection portion 13. More particularly, according to an embodiment of the barrier 1, the transverse extension of the connection portion 13 at the second transverse portion 27 is at a maximum between the ends 29, 30 of the connection portion 13 and at a minimum at the ends 29, 30 thereof. The difference between the maximum and minimum transversal protrusion of the second transverse portion 27 towards an opposite surface of the groove 24 is indicated with d7 in FIG. 2, and the difference of the transverse protrusion of the lateral portion 26 in an opposite direction, i.e. facing away from said surface of the groove 24 is indicated with d2. The two last-mentioned differences d7, d2 add up to a total variation of the transverse extension $E^T$ of the connection portion 13 at the second transverse portion 27 along the length of the connection portion 13, as shown in FIG. 6. There is a transverse distance $D^T$ between opposite wall sections of the receiving space 11. The transverse distance $D^T$ at a portion of the receiving space 11 where the second transverse portion 27 is to be received has a minimum between the longitudinal ends of the end connection 10 that is adapted to a maximum transverse extension $E^T$ of the connection portion 13 at the second transverse portion 27. That minimum transverse distance $D^T$ of the receiving space 11 is slightly longer than said maximum transverse extension $E^T$. Correspondingly, the lateral extension $E^L$ of the connection portion 13 at the maximum lateral protrusion of the lateral portion 26 is less than the minimum lateral distance $D^L$ of a corresponding portion of the receiving space 11. Thus, there is a play P between the connection portion 13 and the receiving space 11. Thereby, the connection portion 13 will be steadily engaged but still movable in the receiving space 11. As shown in FIG. 7, when approaching the opening 28 of the receiving space 11 the play P increases. This is in order to admit the interconnected barriers 1 to pivot horizontally relative to each other, i.e. to be positioned at an angle to each other in a horizontal plane. The extension difference of the lateral portion 26, also being a difference in lateral protrusion towards the second side of the barrier 1, is indicated with d4 in FIG. 2. The first transverse portion 25 has a surface obliquely facing the first side of the barrier 1. That surface is non-planar, at least longitudinally, and provides a varying lateral/transverse extension of the first transverse portion 25. The total extension difference is indicated with d3 in FIG. 2.

Additionally, the transverse and lateral differences of extension make it possible for the interconnected barriers 1 to be angled in a vertical plane, which facilitates use of them on an uneven ground. If a side force causes an interconnected barrier 1 to pivot about the end connection 10, then at a maximum pivot angle the play P on one side of its connection portion 13 will have become zero and the connection portion 13 will hit the wall surface of the groove of the other barrier 1. This may cause a considerable force to be exerted on the connection portion 13. In order to reduce that force the end caps 9 of the barrier 1 protrudes transversally to such an extent that just before the side of the connection portion 13 hits the wall surface of the groove 24 the end caps 9 on one side of the barriers 1 will hit each other and absorb at least a part of the force of movement. Thus, the size of the play and the transverse protrusion of the end caps 9 are adapted to each other such that the end caps 9 and the end connection 10 cooperate in absorbing a side force causing an excessive pivoting about the end connection 10.

Furthermore, the second side portion 22 of the base portion 12 has a greater transverse extension than the first side portion 21. However, the transverse extension differences d1, d6 of the first and second side portions 21, 22 are the same. The transverse protrusion of the connection portion 13 is greater than the transverse protrusion of the second side portion 22 of the base portion 12. The connection portion 13 has a hook-shape, or J-hook shape, i.e. it forms a hook portion. Consequently, in summary, the differences in transverse and lateral extensions d1-d7 of the end connection 10 form a play P between the wall surfaces of the receiving space 11 and the connection portion 13 received by the receiving space 11. The play P has a minimum between the upper and lower longitudinal ends 19, 20 of the end connection 10 and is greater at the longitudinal ends 19, 20.

Figure 3:
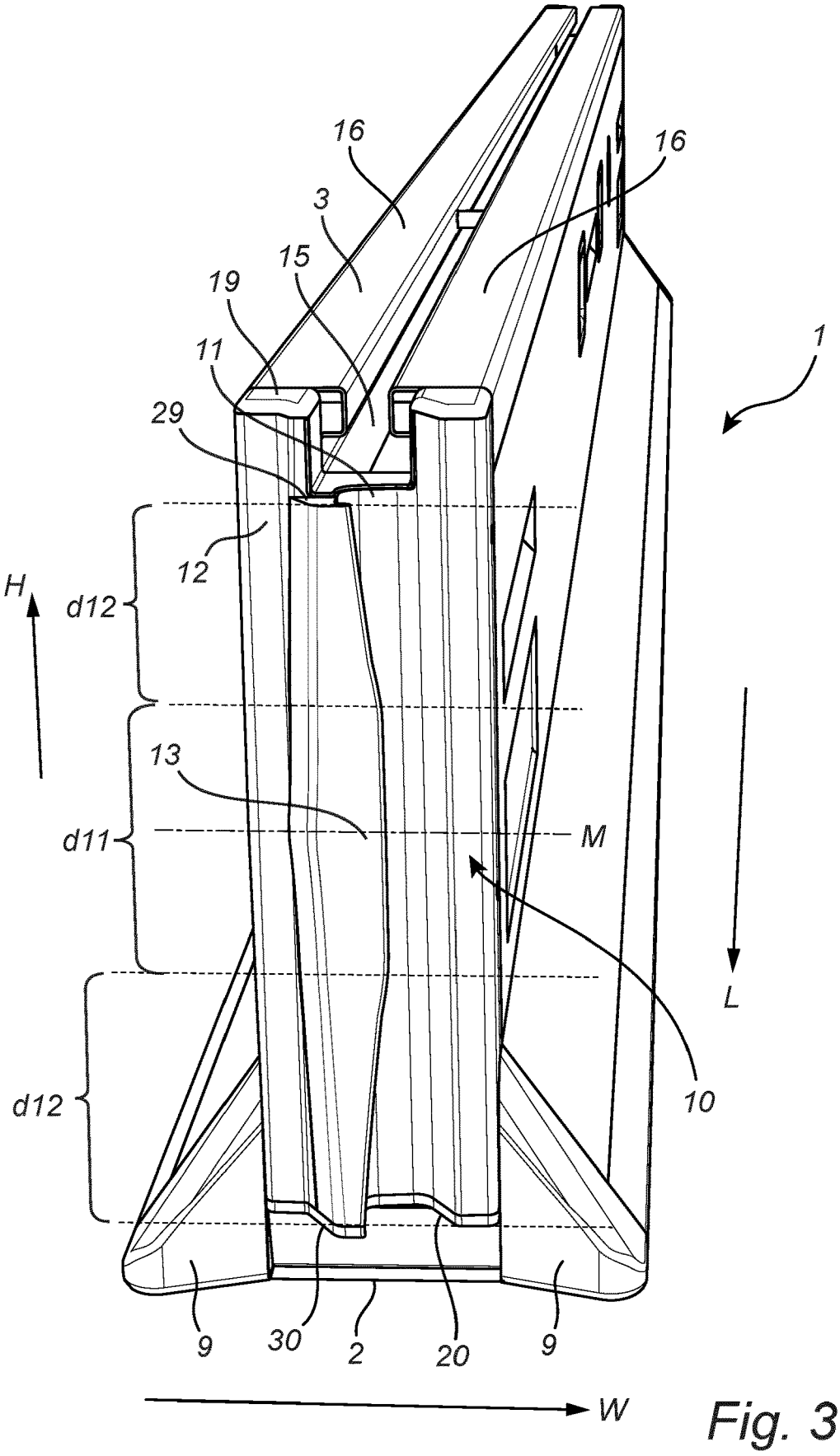
FIG. 3 is a schematic and perspective view of a safety barrier according to one or more exemplifying embodiments of the present invention.

FIG. 3 is a schematic and perspective view of a barrier 1 according to one or more exemplifying embodiments of the present invention. It should be noted that FIG. 3 comprises features, elements and/or functions as shown in FIGS. 1 and 2 and described in the associated text. Hence, it is also referred to those figures and the descriptions relating thereto for an increased understanding. The barrier 1 shown in FIG. 3 is viewed from above, and at an angle. Therefore, an end of the safety barrier 1, a portion of a side of the safety barrier 1 and a portion of the top 3 of the safety barrier 1 are shown.

The end connection 10 comprises the base portion 12 and the connection portion 13. The base portion 12, the connection portion 13 and the receiving space 11 are elongated along the height H of the barrier 1. However, the longitudinal extension of the connection portion 13 is lesser than the longitudinal extension of the base portion 12, wherein the first and second side portions 21, 22 of the base portion 12 have a longitudinal extension all the way to the top 3 of the barrier 1, while the longitudinal extension of the connection portion 13 stops at a longitudinal distance from the top 3, at level with the bottom of the recess 15.

The transverse extension of the end connection 10, and the transverse extension of the connection portion 13, are at a maximum at the longitudinal middle M of the end connection 10. The transverse extension of the end connection 10 is lesser at the longitudinal ends of the end connection 10. The transverse extension of the connection portion 13 is lesser at the longitudinal ends 29, 30 of the connection portion 13. The connection portion 13 has a lateral extension towards the second side of the barrier 1, i.e. a lateral protrusion towards the second side of the barrier 1, that is the same along a longitudinal middle section d11 of the connection portion 13. From the longitudinal ends of the longitudinal middle section d11 to the longitudinal ends of the connection portion 13, longitudinal end sections d12, the lateral extension towards the second side of the barrier 1 is decreasing such that it reaches a minimum at the longitudinal ends of the connection portion 13, and so does the total lateral extension of the connection portion 13. The connection portion 13 is partly covering the receiving space 11.

Figure 4:
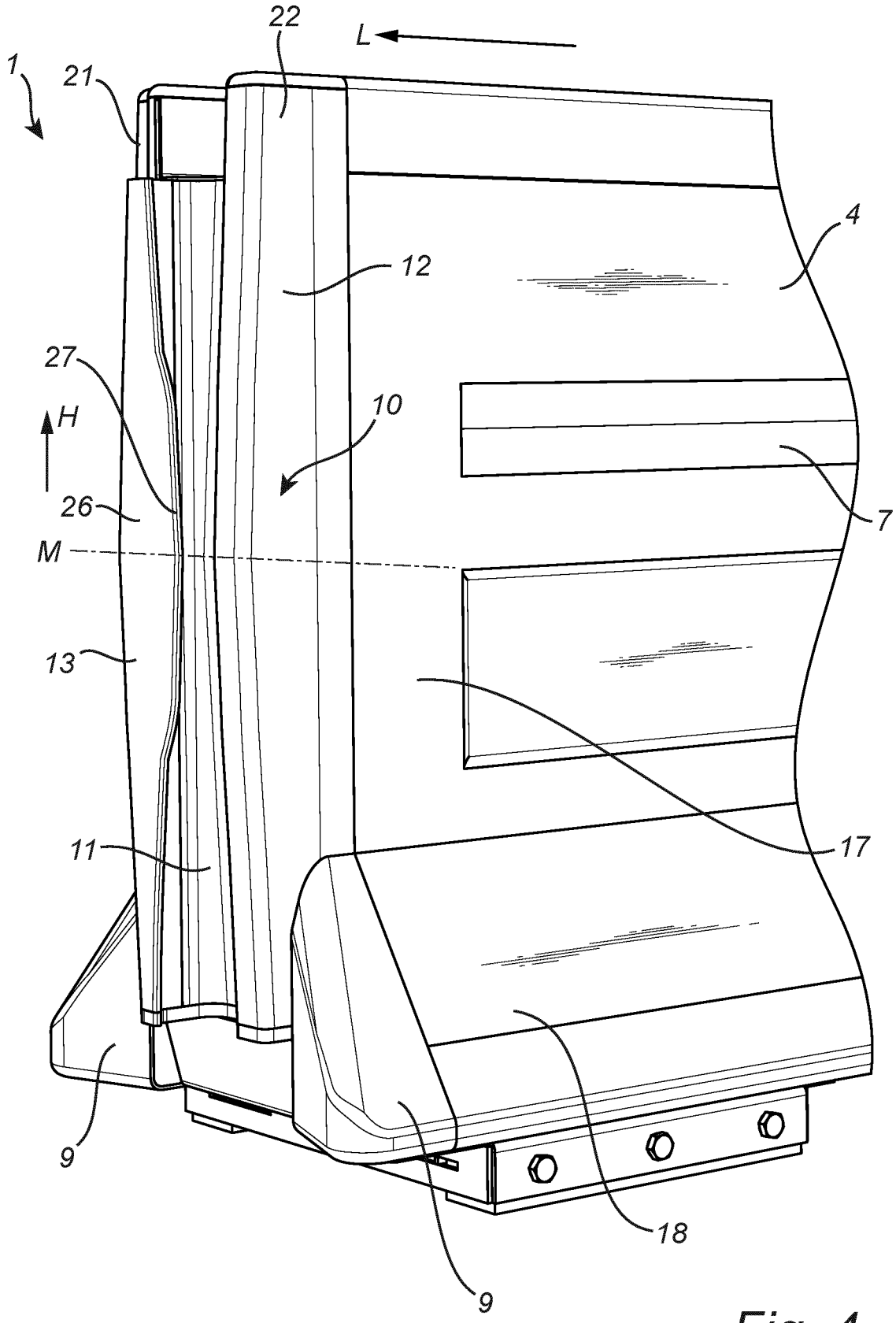
FIG. 4 is a schematic and perspective view of a safety barrier according to one or more exemplifying embodiments of the present invention.

FIG. 4 is a schematic and perspective view of a safety barrier according to one or more exemplifying embodiments of the present invention. It should be noted that FIG. 4 comprises features, elements and/or functions as shown in FIGS. 1-3 and described in the associated text. Hence, it is also referred to those figures and the descriptions relating thereto for an increased understanding. The perspective view of FIG. 4 is such that an end and a side of the body 4 of the barrier 1 is shown.

The base portion 12 and the connection portion 13 are blocking view of the left-hand side of the end connection 10. FIG. 4 shows how the transverse protrusion of the connection portion 13 is greater than the transverse protrusion of the second side portion 22 of the end connection 10. There is a transverse distance between the edge of the connection portion 13 and the wall surface of second side portion 22 of the base portion 12. Further, there is a transverse distance between the second transverse portion 27 of the connection portion 13 and the opposite wall surface of receiving portion 11. The latter transverse distance is at a minimum at the longitudinal middle M of the end connection 10, and at a maximum at the longitudinal ends of the end connection 10. The lateral extension of the connection portion 13 being at maximum at the longitudinal middle M and being at a minimum at the longitudinal ends of the end connection 10, combined with the characteristics of the transverse distance mentioned above defines a distance between wall surfaces of the receiving space 11 that is at a minimum between upper and lower longitudinal ends of the connection portion 13 and is greater at the longitudinal ends. Preferably, the distance between wall surfaces of the space 11 is at a minimum at the longitudinal middle M of the end connection.

Figure 5:
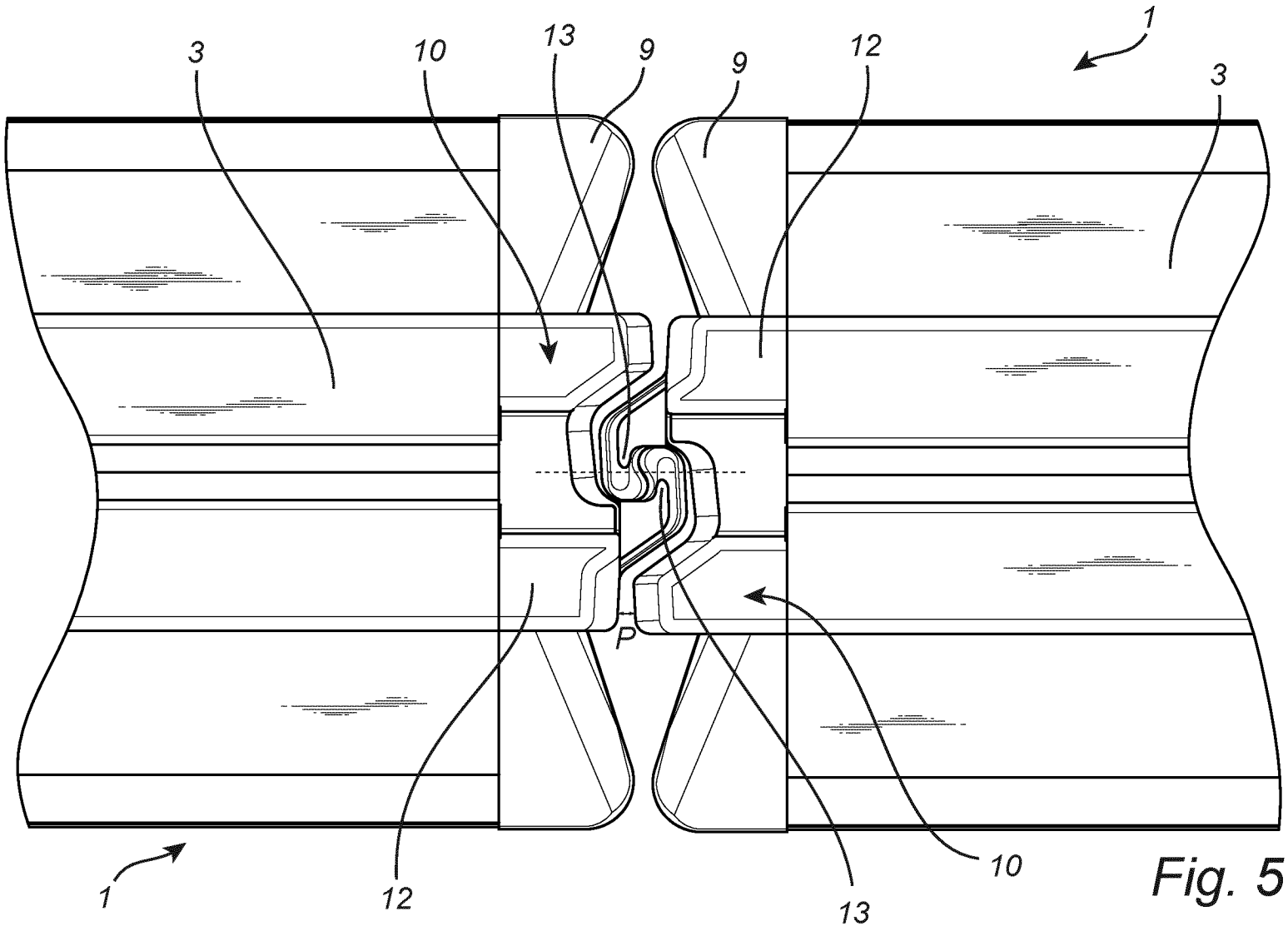
FIG. 5 is a schematic and perspective view of two engaged safety barriers according to one or more exemplifying embodiments of the present invention.

FIG. 5 is a schematic and perspective view of two engaged barriers 1 according to one or more exemplifying embodiments of the present invention. It should be noted that FIG. 5 comprises features, elements and/or functions as shown in FIGS. 1-4 and described in the associated text. Hence, it is also referred to those figures and the descriptions relating thereto for an increased understanding. The two engaged safety barriers shown in FIG. 5 are viewed from above.

The two barriers 1 are engaged. In other words, the two barriers are, for example, interlocked, locked together, or connected. The two engaged barriers 1 are arranged in line with each other. In other words, the longitudinal axes of the barriers 1 are parallel. However, the barriers 1 are not limited to being parallel with regards to their longitudinal axes. It is to be understood that the present inventive concept allows for two engaged barriers to be arranged at an angle, with regards to their longitudinal axes.

Figure 8:
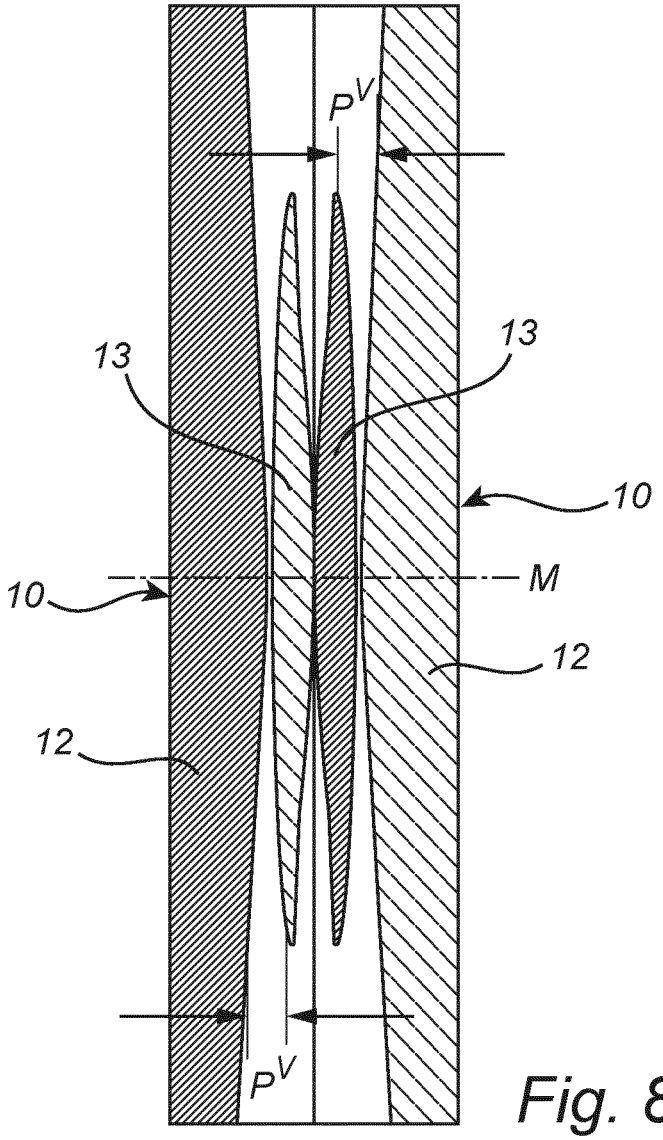

The end connection 10 of each barrier 1 is engaged with the end connection 10 of the corresponding barrier 1. In other words, the connection portion 13 of each barrier 1 has been inserted into the receiving space 11 of the corresponding barrier 1, and is engaged with wall portions of the receiving space 11 thereof provided by the base portion 12 and the connection portion 13. The receiving space 11 is bigger than the connection portion 13, i.e. there is a play P between them. However, there is essentially no play between the connection portions 13 of the barriers 1 at the most narrow point of engagement, while it widens towards the longitudinal ends of the connection portions 13. In other words, in a vertical orientation, the play P between the connection portion 13 and the corresponding connection 13 portion of the other barrier 1 is at a minimum between upper and lower longitudinal ends of the connection portions 13 and is greater at the longitudinal ends. This is at least true when the ground that the barriers 1 rest on is even. Similarly, in a horizontal orientation, the play P is at a minimum at the end, which could be regarded as an outer end or a free end, of the connection portion 13 and increases towards the opening 28 of the receiving space 11. The play in the vertical orientation is also denoted vertical play $P^V$, as illustrated in FIG. 8, and the play in the horizontal orientation is also denoted horizontal play $P^H$, as illustrated in FIG. 7. FIG. 7 shows a horizontal sectional view of the end connection 10. As explained above, the end caps 9 are arranged to protrude transversally such that, if the barriers 1 are rotated about the interconnection between them, the end cap 9 of one barrier 1 will come into contact with the end cap 9 of the other barrier before the play, i.e. the horizontal play $P^H$, of the interconnection has become zero.

Figure 9:
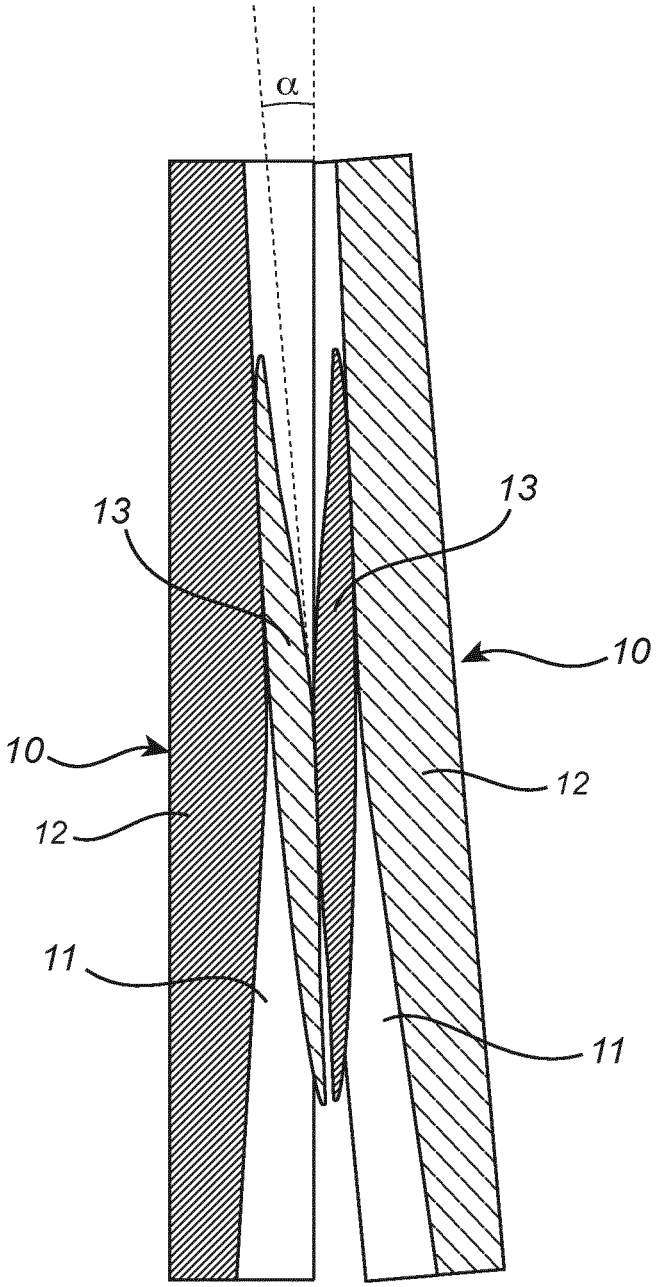

In a vertical section taken along the line I-I in FIG. 7, FIGS. 8 and 9 illustrate how the play in the end connection 10, which play has been obtained by the shapes of the connection portion 13 and the receiving space 11, allows a vertical angle $\alpha$ between two interconnected barriers 1, typically caused by an uneven ground. More particularly, as shown in FIG. 8, when the barriers 1 are placed on an even ground the play, i.e. the vertical play $P^V$, is at a minimum at the longitudinal middle M of the end connection 10 and increases towards the longitudinal ends of the connection portion 13. At a maximum vertical angle $\alpha$ the vertical play $P^V$ is zero. This means that a surface portion of the connection portion 13 of each barrier 1 abuts against a corresponding surface portion of the receiving space 11 of the end connection 10 of the other barrier 1.

The invention claimed is:

1. A safety barrier, the safety barrier having a length, a width, and a height, wherein the safety barrier has an end connection at an end of the safety barrier, which end connection is arranged to be connected with a corresponding end connection of another safety barrier, wherein the end connection comprises a receiving space adapted to receive at least a portion of an end connection of another safety barrier, and to only enable connection and disconnection with said corresponding end connection of another safety barrier by movement of the safety barriers relative to each other in the direction of the height of the safety barrier, wherein a distance through the receiving space between wall surfaces of the receiving space in the direction of the length of the safety barrier is at a minimum between upper and lower ends of the end connection and is greater at the ends, wherein the end connection comprises a shape such that, when received by a receiving space of the end connection of the other safety barrier, it allows for tilt of the safety barrier with regard to the other safety barrier, and wherein a wall surface portion of the end connection located where the distance through the receiving space is longer than the minimum distance is configured to engage with a wall surface portion of the end connection of the other safety barrier when the safety barrier is tilted.

2. A safety barrier according to claim 1, wherein a distance through the receiving space between wall surfaces of the receiving space in the direction of the width of the safety barrier is at a minimum between the upper and lower ends of the end connection and is greater at the ends.

3. A safety barrier according to claim 1, wherein the end connection is elongated in the direction of the height of the barrier, and wherein the distance is at a minimum at the longitudinal middle of the end connection.

4. A safety barrier according to claim 1, wherein the end connection is elongated in the direction of the height of the safety barrier, and wherein the distance is at a maximum at longitudinal ends of the end connection.

5. A safety barrier according to claim 1, wherein the end connection has a longitudinal extension along the height of the safety barrier, a lateral extension along the width of the safety barrier, and a transverse extension along the length of the safety barrier, and wherein the end connection has a transverse protrusion which is at a maximum between longitudinal ends of the end connection and is lesser at the ends.

6. A safety barrier according to claim 5, wherein the transverse protrusion is at a maximum at the longitudinal middle of the end connection.

7. A safety barrier according to claim 5, wherein the transverse protrusion is at a minimum at the longitudinal ends of the end connection.

8. A safety barrier according to claim 1, wherein the end connection further comprises a base portion, and a connection portion protruding from the base portion in the direction of the length and width of the safety barrier, wherein each of the base portion and the connection portion is elongated and has a longitudinal extension along the height of the safety barrier, a lateral extension along the width of the safety barrier, and a transverse extension along the length of the safety barrier.

9. A safety barrier according to claim 8, wherein the base portion comprises a longitudinal groove, wherein a wall surface of the groove and a wall surface of the connection portion define the receiving space, such that the receiving space is adapted to receive the connection portion of another safety barrier, wherein the connection portion is arranged to engage with the corresponding connection portion of the other safety barrier.

10. A safety barrier according to claim 9, wherein a distance through the receiving space between the wall surfaces of the groove and the connection portion is at a minimum between longitudinal ends of the connection portion and is greater at the longitudinal ends.

11. A safety barrier according to claim 8, wherein a transverse extension of the connection portion is at a maximum between longitudinal ends of the connection portion and is lesser at the longitudinal ends thereof.

12. A safety barrier according to claim 8, wherein a transverse extension of the connection portion is at a minimum at longitudinal ends of the connection portion.

13. A safety barrier according to claim 8, wherein the lateral extension of the connection portion is at a maximum between upper and lower longitudinal ends of the connection portion and is lesser and the longitudinal ends.

14. A safety barrier according to claim 8, wherein the lateral extension of the connection portion is at a minimum at the longitudinal ends of the end connection.

* * * * *